US005743037A

United States Patent [19]

Martin

[11] Patent Number: 5,743,037

[45] Date of Patent: Apr. 28, 1998

[54] FOLDABLE ORNAMENTAL SIGN

[76] Inventor: Neil Ronald Martin, 206 N. Barnes, Tonkawa, Okla. 74653

[21] Appl. No.: 638,718

[22] Filed: Apr. 29, 1996

Related U.S. Application Data

[63] Continuation of Ser. No. 287,527, Aug. 8, 1994, abandoned.

[51] Int. Cl.[6] ..... G09F 15/00

[52] U.S. Cl. ..... 40/610; 40/606; 16/388

[58] Field of Search ..... 40/605, 606, 610, 40/534, 540, 608; 248/224.3; 16/382, 388

[56] References Cited

U.S. PATENT DOCUMENTS

| | | | |
|---|---|---|---|
| 892,615 | 7/1908 | Perry | 40/605 |
| 1,308,680 | 7/1919 | Price | 40/610 |
| 2,584,713 | 2/1952 | Kanaval | 40/606 X |
| 2,823,473 | 2/1958 | Jacobs | 40/605 |
| 3,557,479 | 1/1971 | Allison et al. | 40/610 |
| 3,608,221 | 9/1971 | Harris | 40/610 X |
| 3,680,238 | 8/1972 | Arnold | 40/605 X |
| 4,063,330 | 12/1977 | Triplette | 16/388 X |
| 4,309,836 | 1/1982 | Knapp | 40/606 X |
| 4,631,849 | 12/1986 | Jeffery | 40/606 X |
| 5,083,390 | 1/1992 | Edman | 40/610 X |

FOREIGN PATENT DOCUMENTS

| | | | |
|---|---|---|---|
| 2338349 | 8/1977 | France | 40/610 |
| 2496727 | 6/1982 | France | 40/610 |
| 2645186 | 10/1990 | France | 40/606 |
| 2710419 | 9/1978 | Germany | 40/610 |
| 829538 | 3/1960 | United Kingdom | 40/610 |
| 2124727 | 2/1984 | United Kingdom | 16/388 |

*Primary Examiner*—Jose V. Chen
*Assistant Examiner*—James O. Hansen

[57] ABSTRACT

A display sign which can be folded in to a single compact assembly dimensioned to fit, when folded, can be inserted into a standard shipping carton. The design incorporates hinges which are attached between each foldable section, which hinges can be locked by screws to form a rigid unit. A vertically stabilized unit is provided by securing the vertical portion of the display to a base using removable braces between the base and the display and includes removable attachment structure between the base and the display to rigidly attach the display to the base. The lights are attached permanently by using hinges to join the various portions of the display and by passing the wires over the pivot portion of the hinge so that the wires will not become crimped, broken or detached.

1 Claim, 3 Drawing Sheets

FOLDABLE ORNAMENTAL SIGN

This application is a continuation application of Ser. No. 08/287,527 filed Aug. 8, 1994 now abandoned.

BACKGROUND OF THE INVENTION

This invention relates to ornamental signs but could relate to any structure which is too big to ship in a standard shipping carton. When a sign or display is too large to be shipped in a standard shipping carton which is generally three feet by four feet by five inches in width, length and thickness, then the article must be either manufactured in sections which must be assembled after arrival at the location where it is to be used, or it must be shipped by rail or truck. In either case the units must be packaged for such shipment in a very sturdy carton. In addition to the above, if the ornamental sign is a Christmas ornament, then the lights cannot be added until the sign is assembled.

BRIEF DESCRIPTION OF THE INVENTION

This invention obviates all of the above disadvantages described above. The sign is made of one or more foldable units, each of which is hinged to the adjoining unit in a manner to permit the entire sign to be folded to a maximum width and length of three feet by four feet by five inches thick. furthermore, if the lights are added prior to shipment, then the light wires can be installed to cross on the hinge pin side of the fold, thereby permitting the sign to be folded without having to disconnect or remove the lights.

DETAILED DESCRIPTION OF THE INVENTION

Figure 1:
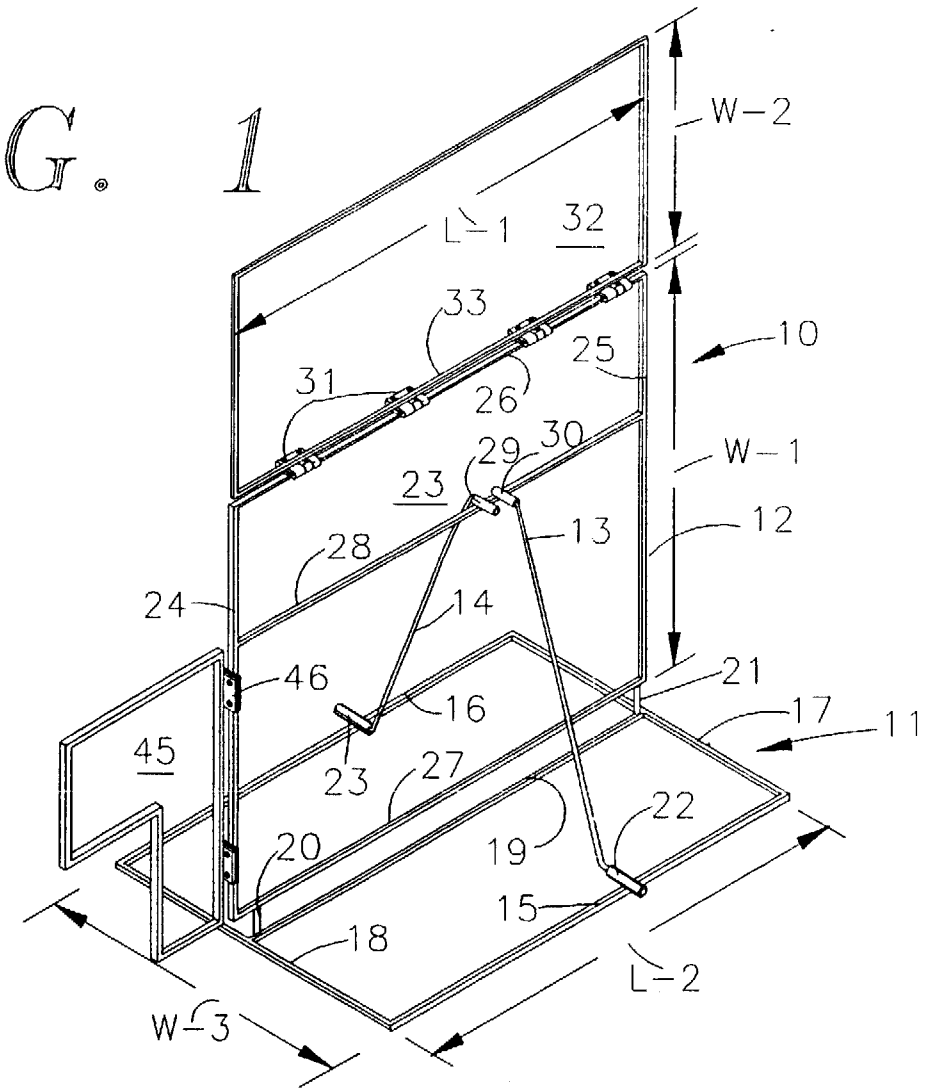
FIG. 1 is a isometric drawing of the display in its fully assembled position.

Referring to all of the figures but in particular to FIG. 1, a display or ornamental sign 10 consists generally of a base generally referred to by arrow 11, a display unit generally referred to by arrow 12 and first and second braces 13 and 14, respectively.

Base 11 is illustrated as having sides 15 and 16 and ends 17 and 18. A central member 19 is attached to each of the ends 17 and 18 by any usual means such as welding or screwing. Display support members 20 and 21 are attached normal to the surface of base 11. The detailed description of the support members 20 and 21 will be described in detail in FIG. 4.

Figure 8:
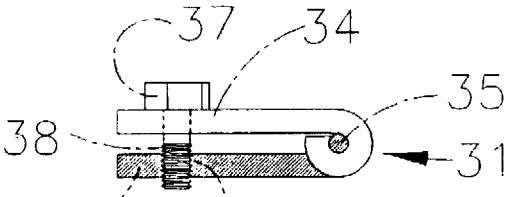
FIG. 8 is a crossection of FIG. 7 taken through lines 7—7.
Figure 9:
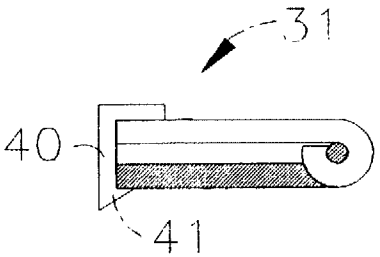
FIG. 9 is a side view of the hinge locking apparatus showing an alternate means of locking the hinge.
Figure 7:
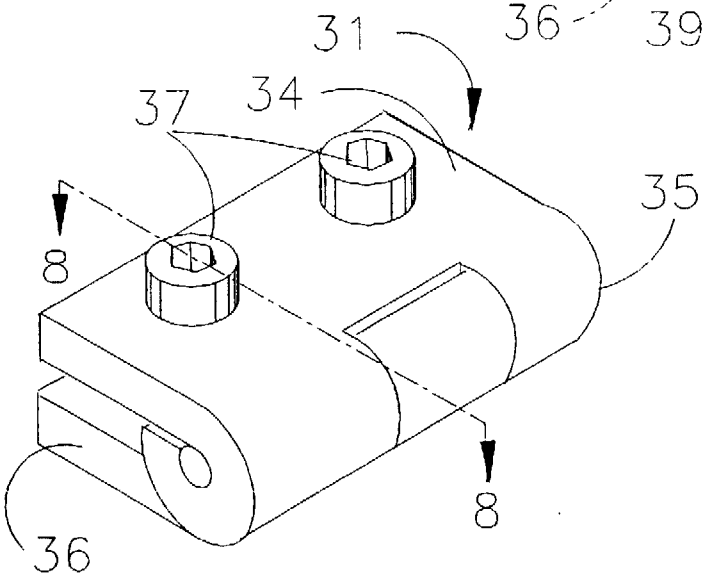
FIG. 7 is a perspective view of the hinge and locking means.

Brace support members 22 and 22*a* are attached to sides 15 and 16 by welding or other means and consist of a tubular member positioned on sides 15 and 16 along the plane of base 11 and positioned to provide an anchor means for braces 13 and 14 respectively. The main display unit 12 is illustrated as having a main portion 23 which basicly has side portions 24 and 25 and an upper porion 26 and a lower portion 27. A central bar 28 is illustrated in FIG. 1 as the supporting member for the mating brace supporting members 29 and 30. It is obvious that brace supporting members can be placed at any location on display unit 12 such as side 26. Furthermore, the location of brace supporting members 29 and 30 can be positioned at any location along bar 28, for example. Width W-1 is configured to be of a dimension not to exceed the maximum width permitted by shipping regulations for cartons as specified by carriers such as United Parcel Service, a shipping company incorporated in the United States of America. In their case, the carton must not exceed three feet in width, four feet in length and five inches in thickness. In order to accommodate these regulations, display sign 10 is made foldable by placing hinges 31 spaced along upper portion 26. A second portion of display 32 is attached to hinges 31 along its lower portion 33. Hinges 31 are attached by any usual means such as welding. A detail of the hinge is illustrated in FIG. 7 and FIG. 8 and shows an upper leaf 34, pivot portion 35 and a lower leaf 36. A pair of bolts 37 passes through the upper leaf 35 through a hole 38 and into a threaded portion 39 in lower leaf 36. Other methods for securing the hinge in a closed position are possible as illustrated in FIG. 9 wherein a snap catch 40 has a lip 41 which catches and engages lower leaf 36 from opening when the display is erected.

A Third portion 45 is attached through hinges 46 to side portion 24. Hinges 46 are the same configuration as hinges 31 as described in FIGS. 7,8 and 9 and attached in the same manner.

Figure 3:
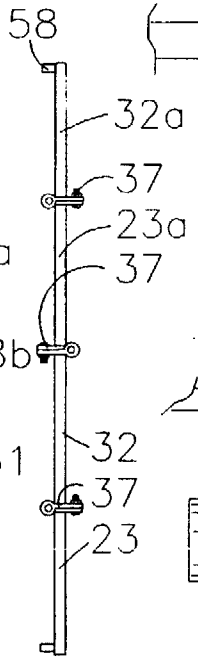
FIG. 3 is a side view of the invention extended and bolted for display.
Figure 2:
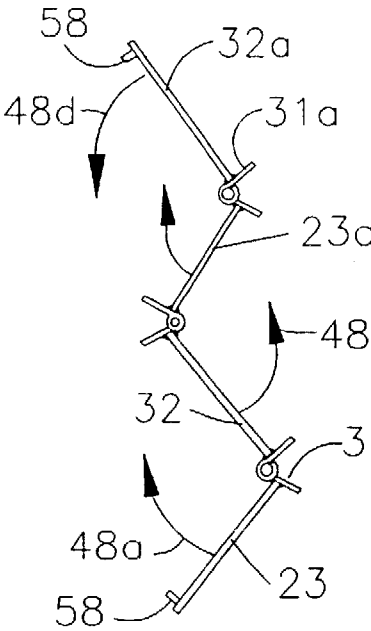
FIG. 2 is a side view of the invention being folded for shipment.

Referring to FIG. 2 and FIG. 3, the folding of the display is illustrated. In the illustration of FIG. 2 and FIG. 3, more than two sections are illustrated, if the main portion 23 was attached as illustrated in FIG. 1, then hinge 31 would attach second portion 32. If additional portions 23*a* and 32*a* are attached to 32 through hinges 31*a*, then the entire assembly could be folded by removing screws 37 (see FIG. 3 and FIG. 7) and moving each of the portions as illustrated by arrows 48*a*–48*d*. It is obvious that the unit will collapse to a singed stack of units having a dimension of three feet by four feet by five inches thick as previously described. Additional side units such as 45 in FIG. 1 could be attached and still be foldable.

Figure 4:
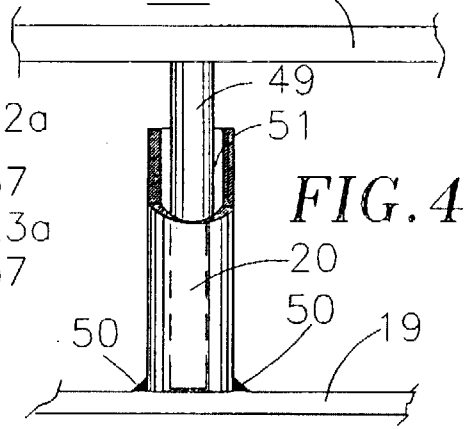
FIG. 4 is a detail partial crossection of the attachment of the display to the base.

The base attachment main portion 23 is best illustrated in FIG. 4 In that figure, base 11 has display support member 20 welded thereto by welds 50. support member 20 is a tube having its internal opening 51 dimension to receive a pin 49 which has been attached to lower portion 27 of main portion 23 by any usual means such as the use of welds or screws. Usually two such assembles illustrated in FIG. 4 are used to mount a display, however more than two can be utilized if desired or necessary.

Figure 5:
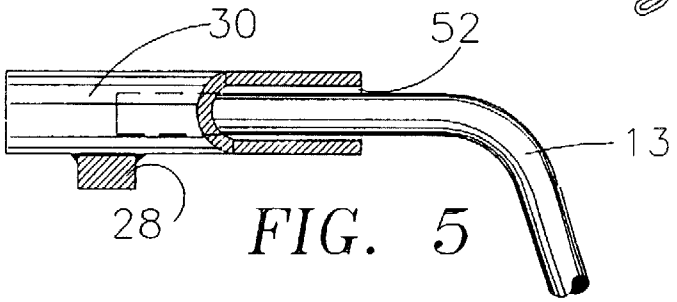
FIG. 5 is a detail partial crossection of the angular brace between the base and the display.

Vertical support for the display comprises braces 13, display support members 22 and 22*a* and brace support members 29 and 30. Referring to FIG. 1 and FIG. 5, a detail of brace support member 30 is illustrated. Display support members 20,21 and brace support members 29 and 30 are all constructed in the same way as that illustrated in FIG. 5. The only difference is the configuration of brace 13 which will have a different direction of bend depending upon the location of the support member. Brace 13 is inserted into opening 52 and in to a corresponding opening in brace support member 22. Brace support member 22 ad display support member 30 are tubes which are welded to their corresponding central bar 28 and end 15 respectively. Two braces 14 and 13 are used to fully support the display sign 10. The supports 22*a* and 29 are identical to those already described in FIG. 5.

Figure 6:
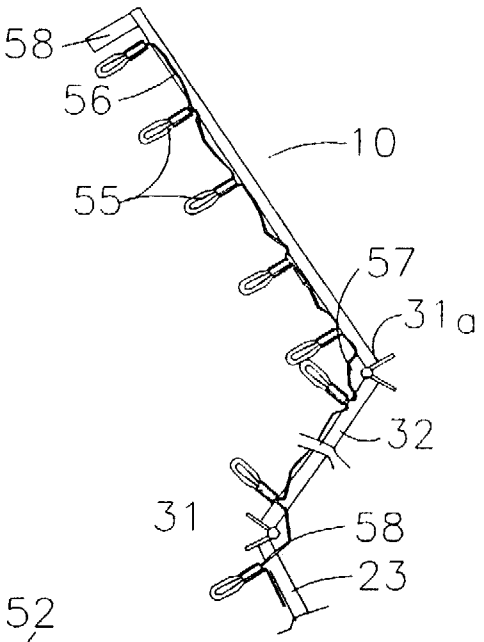
FIG. 6 is a side view of a portion of the display with the wires attached illustrating the means for folding without the need for removing the wires.

Referring to FIG. 6, the proper attachment of lights is illustrated. Lights 55 are attached so that wires 56 cross hinge 31 on the side 57 and 58 of the pivot portion of hinge 31. This form of assembly will permit display 10 to be folded without having to disassemble lights 55. A Stop 58 protects lights 55 from damage when sections 23, 32 and 32*a* are folded since stop 58 is mounted to strike a portion of section 32 and stop the folding so that the pressure will be on stop 58 and not press against lights 55.

OPERATION

The display sign is formed using two significant portions. Base 11 and display portion 10. The normal method for assembling the display is to first unfold each of the sections 45 and 32 (see FIG. 1)and then insert and tighten all of the screws 37 in each of the hinges 31 (see FIG. 7, 8 and 9). Once screws 37 are tightened, the display is one rigid unit. Display portion 10 is erected by placing pins 49 into internal opening 51 of display support members 20 and 21. The next step is to make the display vertically rigid against wind and the like by inserting braces 13 and 14 into brace support members 30 and 29 respectively. The unit has enough spring in base 11 and display 10 to permit the insertion of braces 13 and 14 into their respective brace support members 22 and 22*a*. Lights 55 have already been assembled onto main portion 23, second portion 32 and third portion 45, so that when the units were unfolded and their hinges secured, lights 55 were already in position for display. The above results in a great deal of time saved by the installer, further it prevents the erroneous mounting of lights, particularly as to location and color. With the light wires 56 cross at 57 and 58, for example, on the side of the pivot of hinge 31, the wires will not be stretched, dislocated or damaged when the display is folded for shipment as illustrated in FIGS. 2 and 6.

CONCLUSIONS

A unique sign display unit has been disclosed which has several advantages over those currently known, first, it can be dissembled and folded in to a unit which can be shipped in a standard shipping carton, thus, eliminating the need to crate and ship by overland carrier; second, the unit can be shipped with all of the lights installed, thus, eliminating the need for the recipient to reinstall the lights after receipt and after each use of the unit. Further the unit can be stored in a small package and not as an assembled unit thereby increasing the number that can be stored in a warehouse, and further preventing damage to the unit since the lights will be protected during storage rather than exposed during the warehousing of the unit between seasons of use.

A unique means for attaching the base to the display sign has also been disclosed which will allow ease in installation for use and in disassembly for storage.

A unique method for assembly has been disclosed with hinged joints which can be locked once the unit is assembled so that the assembly forms a rigid unit and can just as easily be unlocked for storage.

What I claim is:

1. A display unit having a display portion, said display portion having a main section and a section means, pivotal means for attaching said section means to said main section; means for securing said section means to maintain said section means rigidly positioned with respect to said main section, whereby said section means can be unsecured and pivoted about said pivotal means, folding said section means against said main section for storage or shipping and wherein said section means can be rotated about said pivotal means and secured by said means for securing said section means to said main section, wherein said securing means and said pivotal means includes a hinge having first and second leaves and a pivot means attaching said first and second leaves; an opening through said first leaf, said second leaf having a threaded portion; and bolt means passing through said opening in said first leaf and into said threaded portion in said second leaf in a manner to secure said first leaf to said second leaf.

* * * * *